US005947335A

United States Patent [19]

Milio et al.

[11] Patent Number: 5,947,335

[45] **Date of Patent: *Sep. 7, 1999**

[54] DUAL COMPARTMENT PACKAGE

[75] Inventors: Ronald John Milio, Upton-By-Cheshire, United Kingdom; Kevin Joseph Markey, Westminster, Md.

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,998

[22] Filed: Oct. 15, 1996

[51] Int. Cl.[6] ..... B67D 5/52; B67D 5/60; B65D 37/00; B65D 88/54

[52] U.S. Cl. ..... 222/136; 222/133; 222/134; 222/135; 222/144.5; 222/207; 222/309

[58] Field of Search ..... 222/135, 133, 222/134, 136, 144.5, 207, 309

[56] References Cited

U.S. PATENT DOCUMENTS

| | | | |
|---|---|---|---|
| 3,291,346 | 12/1966 | Marraffino . | |
| 3,459,332 | 8/1969 | Golden . | |
| 3,704,812 | 12/1972 | Marand . | |
| 4,773,562 | 9/1988 | Gueret . | |
| 4,791,149 | 12/1988 | Pocknell . | |
| 4,826,048 | 5/1989 | Skorka . | |
| 4,871,092 | 10/1989 | Maerte . | |
| 4,979,646 | 12/1990 | Andris | 222/136 |
| 4,993,594 | 2/1991 | Becker et al. | 222/48 |
| 5,020,694 | 6/1991 | Pettengill . | |
| 5,038,963 | 8/1991 | Pettengill et al. . | |
| 5,137,178 | 8/1992 | Stokes et al. . | |
| 5,385,270 | 1/1995 | Cataneo et al. . | |
| 5,398,846 | 3/1995 | Corba et al. | 222/1 |
| 5,612,307 | 3/1997 | Chambers et al. . | |

FOREIGN PATENT DOCUMENTS

| | | | |
|---|---|---|---|
| 269068 | 6/1988 | European Pat. Off. | 222/136 |
| 468 703 | 1/1992 | European Pat. Off. . | |
| 3116282 | 11/1982 | Germany | 222/136 |
| 9415848 | 7/1994 | WIPO | 222/136 |
| 97/27841 | 8/1997 | WIPO . | |

*Primary Examiner*—Andres Kashnikow
*Assistant Examiner*—Keats Quinalty
*Attorney, Agent, or Firm*—Gerald J. McGowan, Jr.

[57] ABSTRACT

A dispenser having at least two compartments wherein the amount of product dispensed from at least one of the compartments can be adjusted prior to dispensing. Advantageously, products in both compartments are dispensed using the same actuator. Different volumes of product can be dispensed from at least one of the chambers even through the volume of product dispensed from the other chamber need not be varied and even though the same actuator may be used to effect the dispensing of product.

9 Claims, 8 Drawing Sheets

78
76
102
72
71
74
104
58
54
52
60
62
50
56
66
68
70
48
42
41
46
44
32
34
31
30
36
29
20
28
26
24
22
18
19
16
14
17

FIG. 5
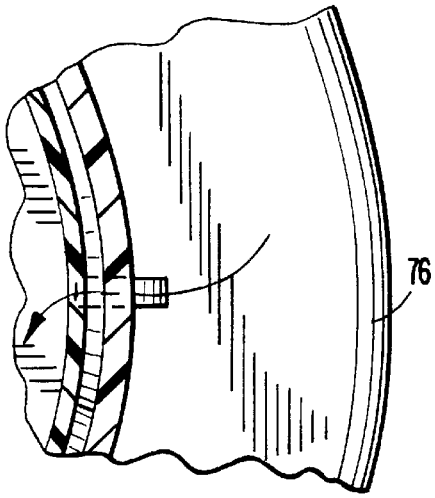
FIG. 6
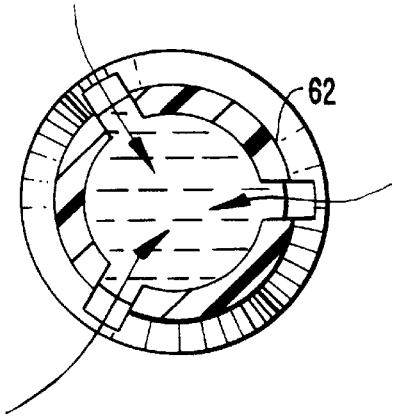
FIG. 7
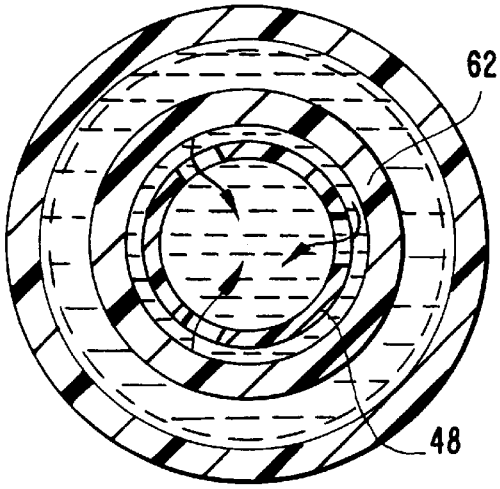
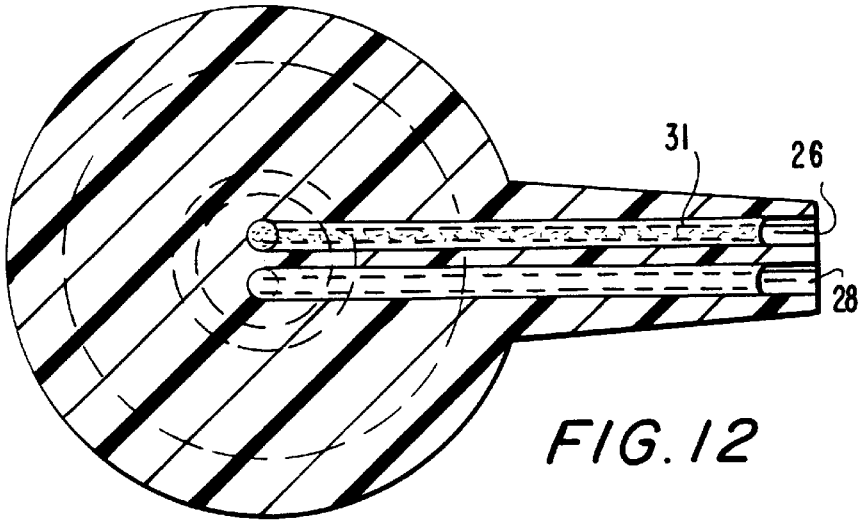
FIG. 12

DUAL COMPARTMENT PACKAGE

BACKGROUND OF THE INVENTION

There is sometimes a need in the packaging of consumer products to keep separated two of the components until such time as the product is actually to be used. An example is the Mentadent® brand of toothpaste. In that product, a peroxide-containing formulation and a bicarbonate-containing formulation are kept separate prior to dispensing to prevent premature interaction of the components.

Another example where it may be desirable to keep components separate in a consumer product would be a cleaning composition where it is necessary to keep a bleaching agent separate from another component such as an enzyme, to avoid undesirable interaction.

Some popular skin products include both surfactants for cleansing and a separate moisturizing ingredient. However, the level of moisturizing ingredient in such formulations is typically fixed and cannot be adjusted by the consumer to tailor the product to the individual consumer's skin condition, e.g. to increase the level of moisturizer for a consumer with excessively dry skin.

Stokes et al., U.S. Pat. No. 5,137,178 discloses a dispenser wherein product components such as facial lotion and makeup can be kept in separate chambers prior to dispensing.

Maerte, U.S. Pat. No. 4,871,092 discloses an atomizing or metering pump wherein it is possible to adjust the metering or atomizing quantity. The metering or atomizing quantity can be adjusted, e.g. by twisting the operating pusher with respect to the pump casing. In one embodiment a projection cooperates with a recess extending over part of the circumference, two ends of the recess limiting the movement of the projection within the recess. In one embodiment, a projection 19A can be set so that the operating pusher can be pressed down to rest on of a number of corresponding steps so that the length of the stroke can be set.

Marraffino, U.S. Pat. No. 3,291,346 discloses a blending device for blending hot water with creme to convert the creme into a wet or moist hot, foamy lather which issues from a shaving creme dispenser. A locking pin is provided to lock the cylinder against movement relative to the sleeve when the device is not in use.

Golden, U.S. Pat. No. 3,459,332 is directed to a pneumatic control system for dispensing metered quantities of liquid from one or more different liquid supply chambers in an automatic manner so that the dispensed liquid will be in proper quantities for providing a predetermined mixture of liquids, each dispensing operation being effected by pneumatically controlled actuator means. At column 2, lines 6–12, it is stated that the various features of the invention are described and illustrated as being particularly adaptable to provide automatic control for two or more liquid dispensing units, but that it is to be understood that the various features of the invention can be utilized singly or in any combination thereof to provide dispensing structure for only a single liquid as desired. In FIG. 5, a stop means is adjusted so that each unit will dispense a predetermined volumetric quantity of its respective supply liquid during each dispensing cycle.

Gueret, U.S. Pat. No. 4,773,562 discloses a dispenser head for mixing separate pasty substances wherein two ducts open into a mixing chamber which in turn opens out to the outside of the container.

Pocknell, U.S. Pat. No. 4,791,149 discloses a package having two separate compartments where the ingredients present in each such compartment do not react with each other, there being a propellant located between a membrane and the container whereby the membrane may be caused by the propellant gas to expel the component when required.

Skorka, U.S. Pat. No. 4,826,048 discloses a dispenser having two reservoirs for separate media components. Each reservoir has a separate discharge pump, both discharge pumps being simultaneously operable by means of a common handle. The pumps are preferably thrust piston pumps. It is said that the components can be brought together in a precisely dosed quantity ratio in accordance with German patent application DE 32 25 910.7

Marand, U.S. Pat. No. 3,704,812 is directed to a dispenser including several fluid components in isolated sack chambers.

Cataneo et al., U.S. Pat. No. 5,385,270 is directed to an apparatus for dispensing two flowable substances in a user selectable ratio. The selector member is selectively rotatable with respect to the container between a series of predetermined positions where the selector member opening is either in full registry, partial registry or not in registry with the open ends of each of the chambers, such as upon compression of the outer container wall. A predetermined measure of flowable substance is dispensed from the dispensing end of the container with a ratio of the flowable substances from the two chambers being selectively variable.

Cordery et al. EP 468 703 discloses a shampoo system comprising a first pack including a surfactant and a cationic conditioning polymer and a second pack containing a benefit agent. The first and second packs are adapted to be mixed together before use. The benefit agent is said preferably to be chosen from among sunscreens, certain silicones, perfumes, hair growth agents, hair moisturizers, anti-dandruff agents, bodying agents, shine enhancers and setting agents.

SUMMARY OF THE INVENTION

The present invention is directed to a dispenser having at least two compartments wherein the amount of product dispensed from at least one of the compartments can be adjusted prior to dispensing. Advantageously, products in both compartments are dispensed using the same actuator. The invention permits dispensing different volumes of product from at least one of the chambers even though the volume of product dispensed from the other chamber need not be varied and even though the same actuator may be used to effect the dispensing of product.

In accordance with another advantageous aspect of the invention, a dispenser is provided which includes at least two chambers for containing product, at least one of the chambers being separately removable and replaceable with a refill. This aspect of the invention is particularly advantageous in combination with the other aforementioned aspect of the invention since permitting consumer adjustment of the volume of individual components dispensed by the container may well result in the exhaustion of the supply of product in the individual chambers at different times. Thus, the consumer can replace each of the chambers when it is empty without unnecessarily discarding another chamber, the contents of which have not yet been fully depleted.

While dual dispensing containers which dispense different products at different rates have been previously suggested, in many such containers the different rates of use of the respective product are compensated for by the manufacturer by use of different sized chambers. This is not the case with the dispenser according to the first embodiment of the present invention, since the manufacturer cannot predict at what rate the components in the chambers will be used due to the ability of the consumer to adjust the rate of dispensing of at least one of the components. Therefore, it will be appreciated that dispensers combining the first and second aspects of the invention will be particularly advantageous.

In accordance with a further aspect of the invention, the individual adjustment of flow rate from one of the chambers results from providing a pump having a combination of a piston which includes a force exerting member together with a force receiving member separate from the piston. At least one of the force exerting member or the force receiving member is movable to positions disposed along a plurality of levels of the dispenser, such levels being spaced along the axis of movement of the compression piston. This permits the volume displaced by the piston in the first chamber to be varied. Meanwhile, the force receiving member is associated with a second chamber and transmits the force to the second chamber once the piston has moved through the entire available volume of the first chamber. At that point, the force transmitted by the force exerting member to the force receiving member and thus to the second chamber is used to dispense product from the second chamber.

In an advantageous embodiment, the force exerting member can be provided in the form of a finger extending from the piston to the force receiving member. The force receiving member may advantageously be provided in the form of steps such that movement of one of the force receiving or force exerting members causes the force exerting finger to be moved from a position above one step to a position above a step at a different level, thereby changing the volume of product displaced by the chamber by movement of the piston.

In a preferred embodiment, one of the chambers includes a surfactant containing-composition and another of the chambers contains a moisturizing-including composition. At least one of the chambers is preadjustable by the consumer, e.g by use of the finger and step arrangement mentioned above. The amount of moisturizer dispensed relative to the amount of surfactant may then be adjusted by changing either the amount of moisturizer or amount of surfactant dispensed from the respective chamber.

In addition to affording the consumer the ability to tailor the final skin composition to his/her needs, this arrangement is believed to be advantageous since improved effects are obtained from moisturizer/surfactant compositions when interaction between the moisturizer and surfactant is prevented prior to actual dispensing.

For a more complete understanding of the above and other features and advantages of the invention, reference should be made to the following detailed description of the preferred embodiments and to the accompanying drawings.

BRIEF DESCRIPTION OF THE DRAWINGS

FIG. 5 is a cross section along the lines 5—5 of FIG. 3.

FIG. 6 is a cross section along the lines 6—6 of FIG. 3.

FIG. 7 is a cross section along the lines of 7—7 of FIG. 3.

FIG. 12 is a cross section along the lines of 12—12 of FIG. 3.

Figure 1:
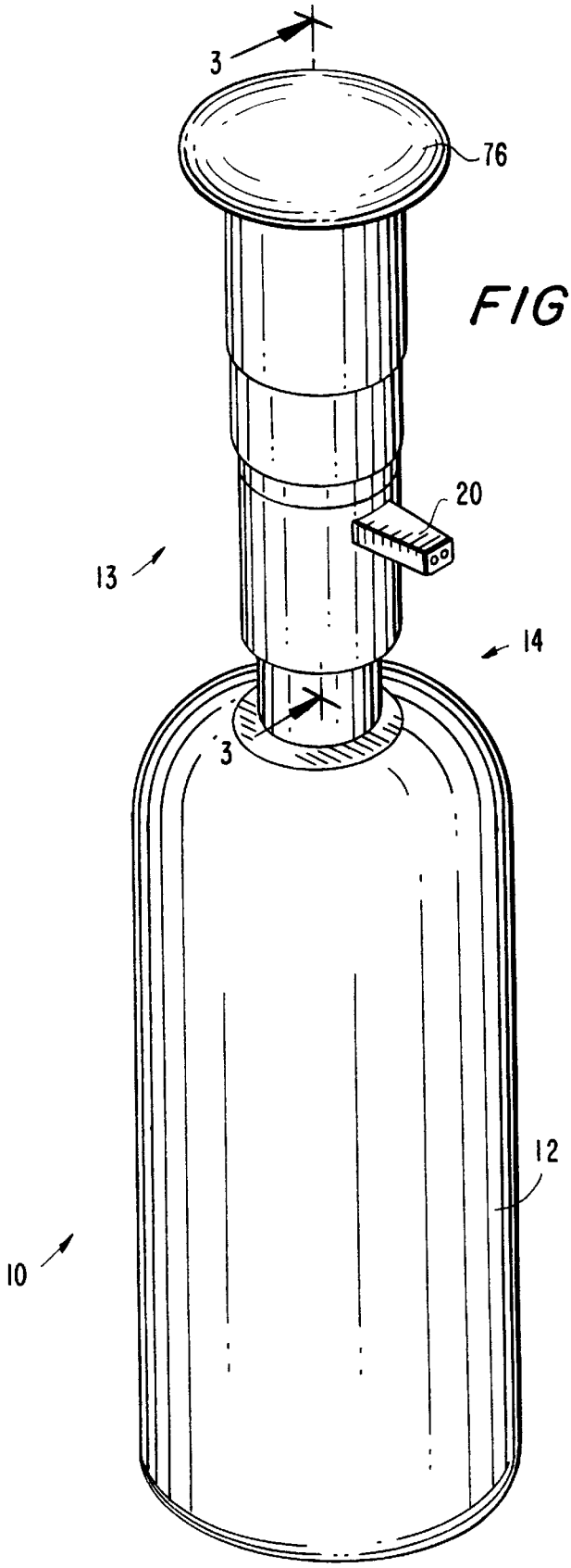
FIG. 1 is a perspective view of the package of the invention.
Figure 2:
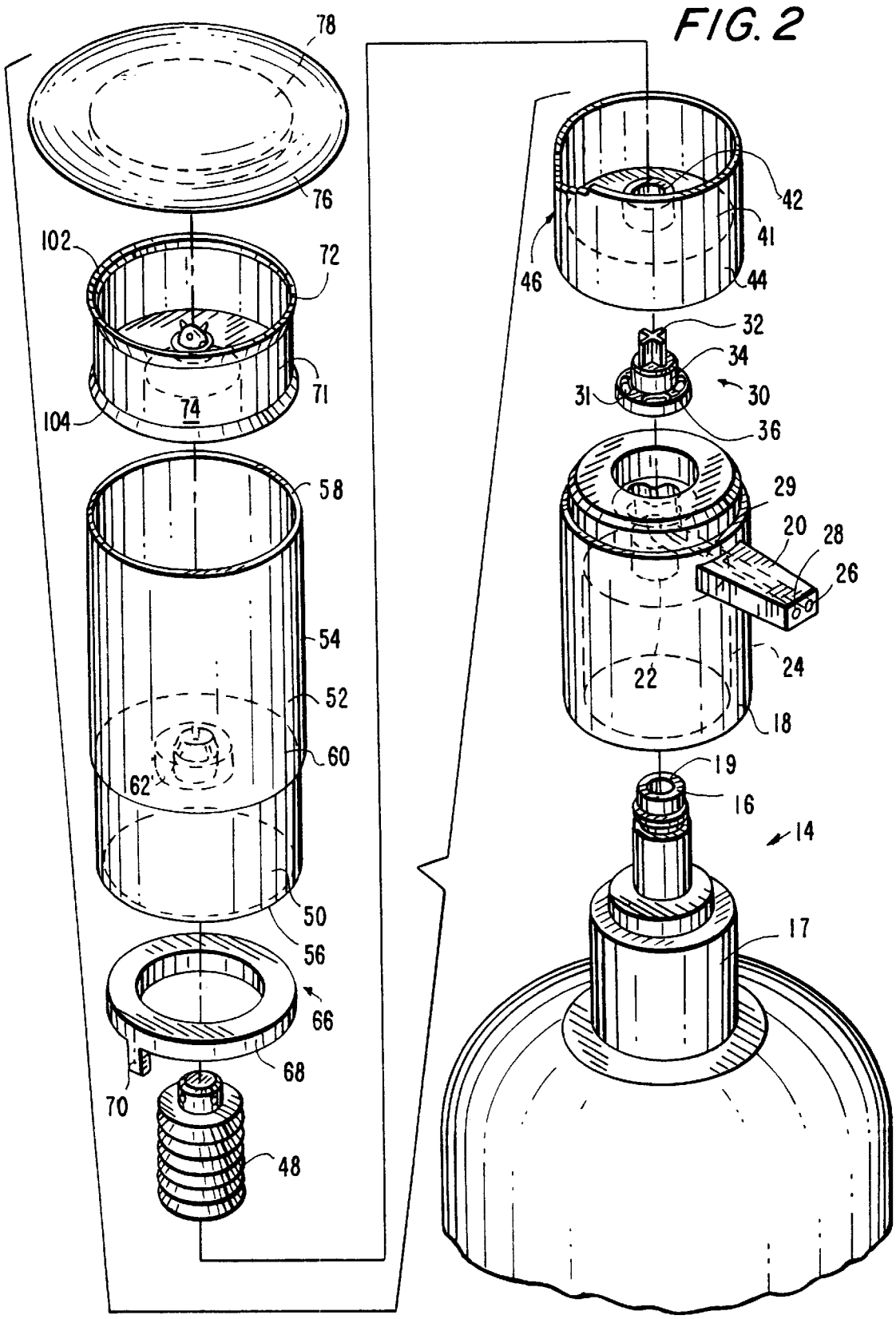
FIG. 2 is an exploded view of the pump of the package of the invention.

Package 10 includes a first dispensing section which includes bottle 12 having pump 14. Pump 14 may be of a conventional type such as the product Megapump available from the Megapump Limited Partnership, 8537 York Road, P.O. Box 410386, Charlotte, N.C. 28241-0386. Included in pump 14 is bottom dispensing cylinder 16 and cylindrical cap 17.

Second dispensing section 13 includes lower shell 18. The interior of lower shell 18 includes narrow cylindrical opening 22 into which cylinder 16 snugly fits and broad cylindrical opening 24 which accommodates cylindrical cap 17.

Spout 20 of lower shell 18 includes two product exit openings, 26 and 28. Opening 26 leads to first product tube 31 which has a downwardly extending bend at its proximal end leading toward cylindrical opening 19 of cylinder 16. Tube 29 has an upwardly turning bend at its proximal end as will be explained in more detail hereinafter. Tube 26 receives product from bottle 12, which includes bottom pump 14, whereas tube 29 receives product from an upper pump in second dispensing section 13 to be described below.

Received within a circular opening of the lower shell 18 is lower valve 30 which is fabricated from a flexible material such as silicone rubber. Lower valve 30 includes a cruciform top 32, a middle cylinder 34 and a bottom cylinder 36. Bottom cylinder 36 is of a greater diameter than middle cylinder 34 and includes apertures 40 which are in communication with the hollow interior of cylinder 36. The interior of cylinder 34 may likewise be hollow.

The cruciform top 32 of lower valve 30 is received within a cylinder 42 of a step shell 44. Middle cylinder 34 and lower valve 30 normally seals against cylinder 42. Step shell 44 includes a series 46 of steps along a portion of its upper perimeter. A platform 41 in which cylinder 42 is formed divides shell 44 into upper and lower outer cylinders.

Figure 3:
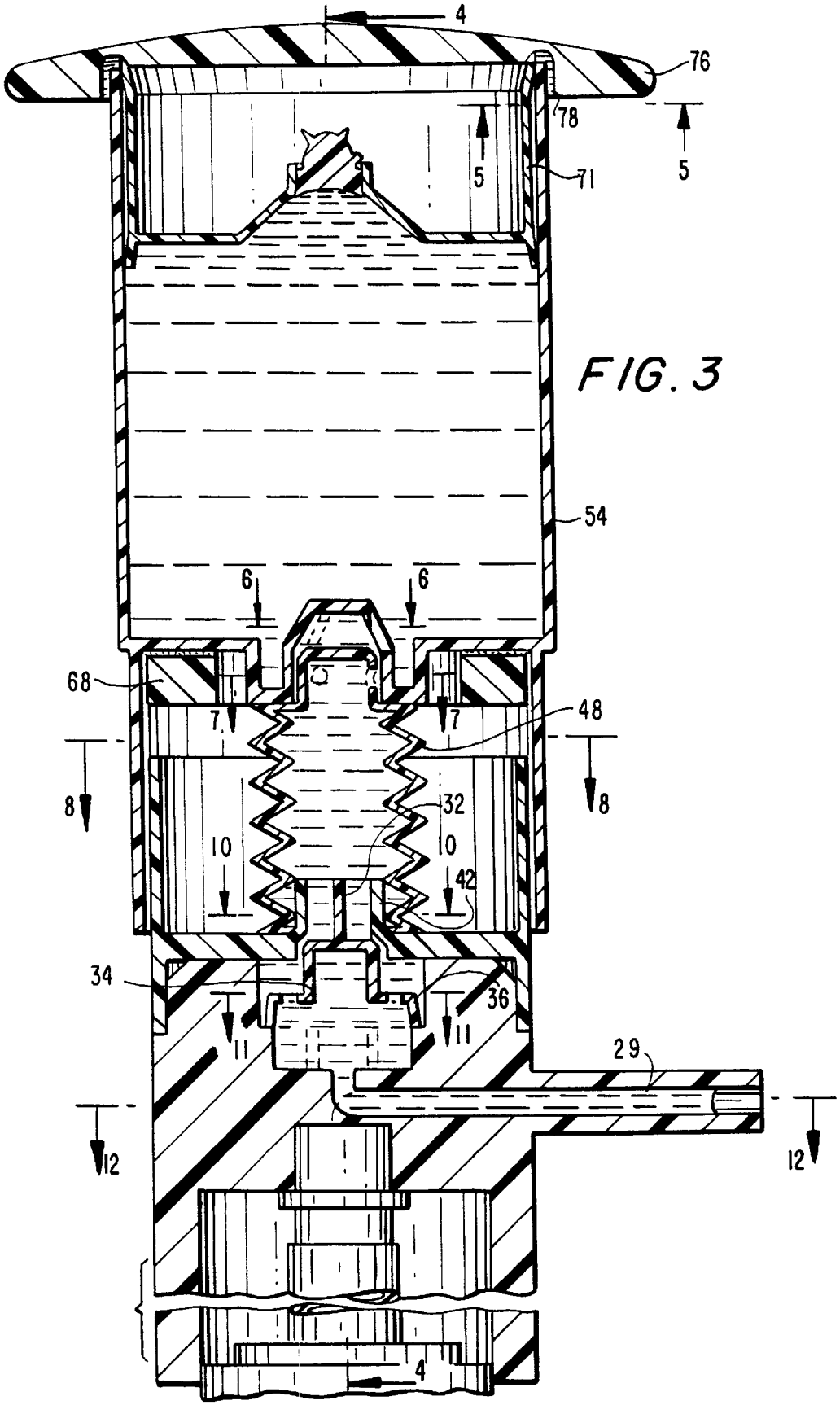
FIG. 3 is a cross section along the lines 3—3 of FIG. 1.
Figure 4:
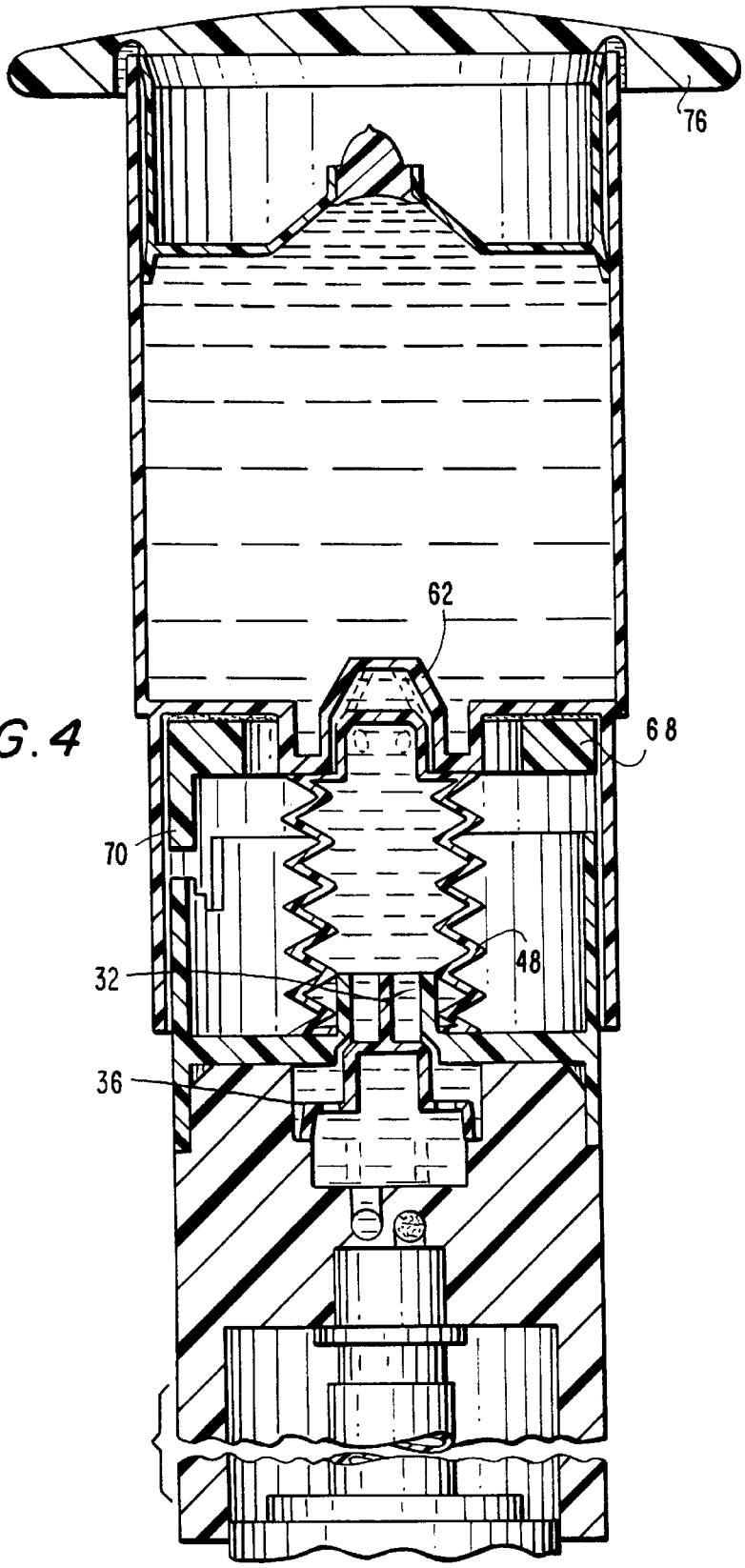
FIG. 4 is a cross section along the lines 4—4 of FIG. 3.
Figure 9:
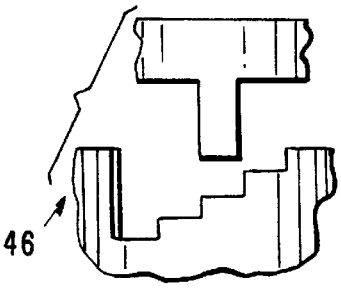
FIG. 9 is a cross section along the lines of 9—9 of FIG. 8.
Figure 8:
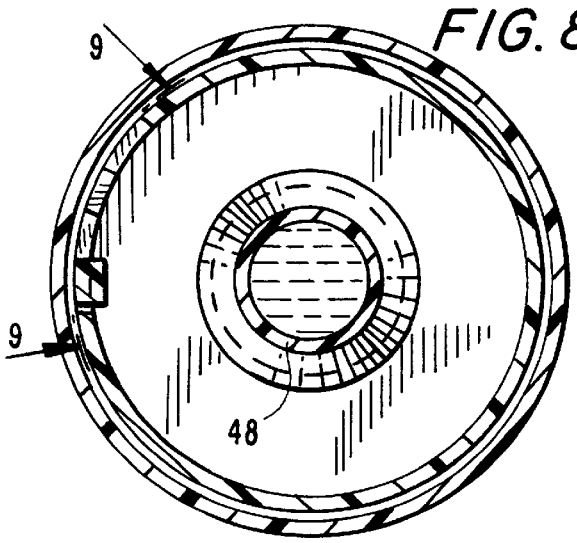
FIG. 8 is a cross section along the lines of 8—8 of FIG. 3.
Figure 10:
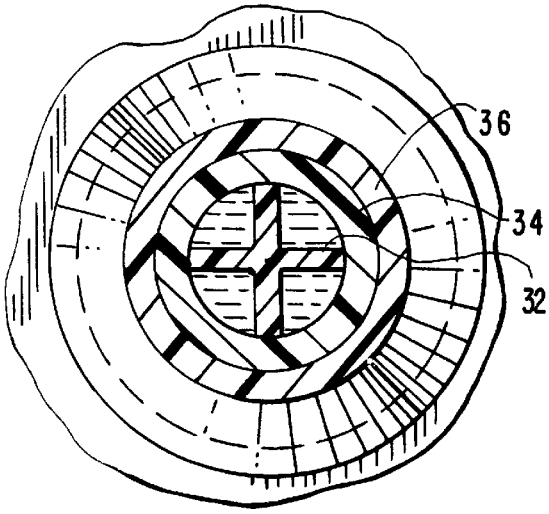
FIG. 10 is a cross section along the lines of 10—10 of FIG. 3.
Figure 11:
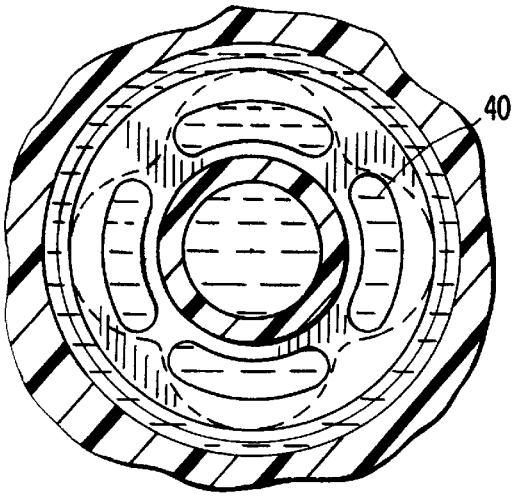
FIG. 11 is a cross section along the lines of 11—11 of FIG. 3.
Figure 14:
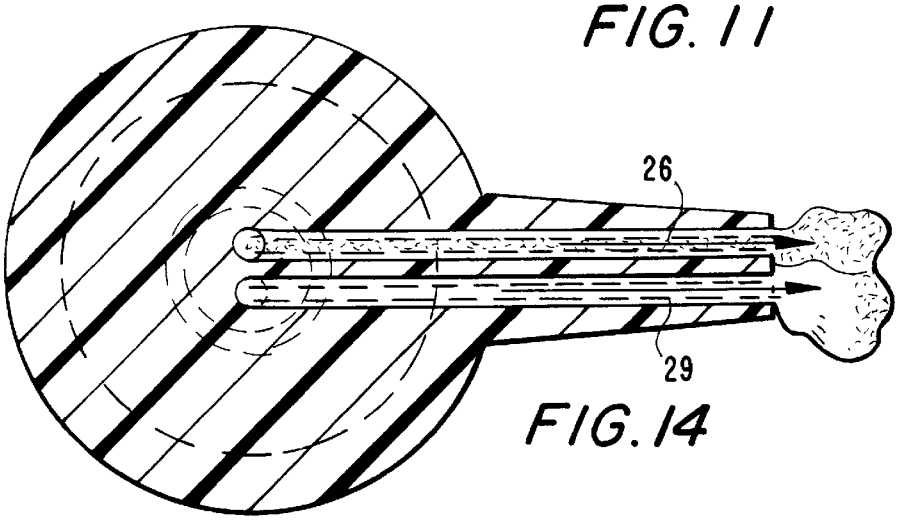
FIG. 14 is a cross section along the lines of 14—14 of FIG. 13.
Figure 13:
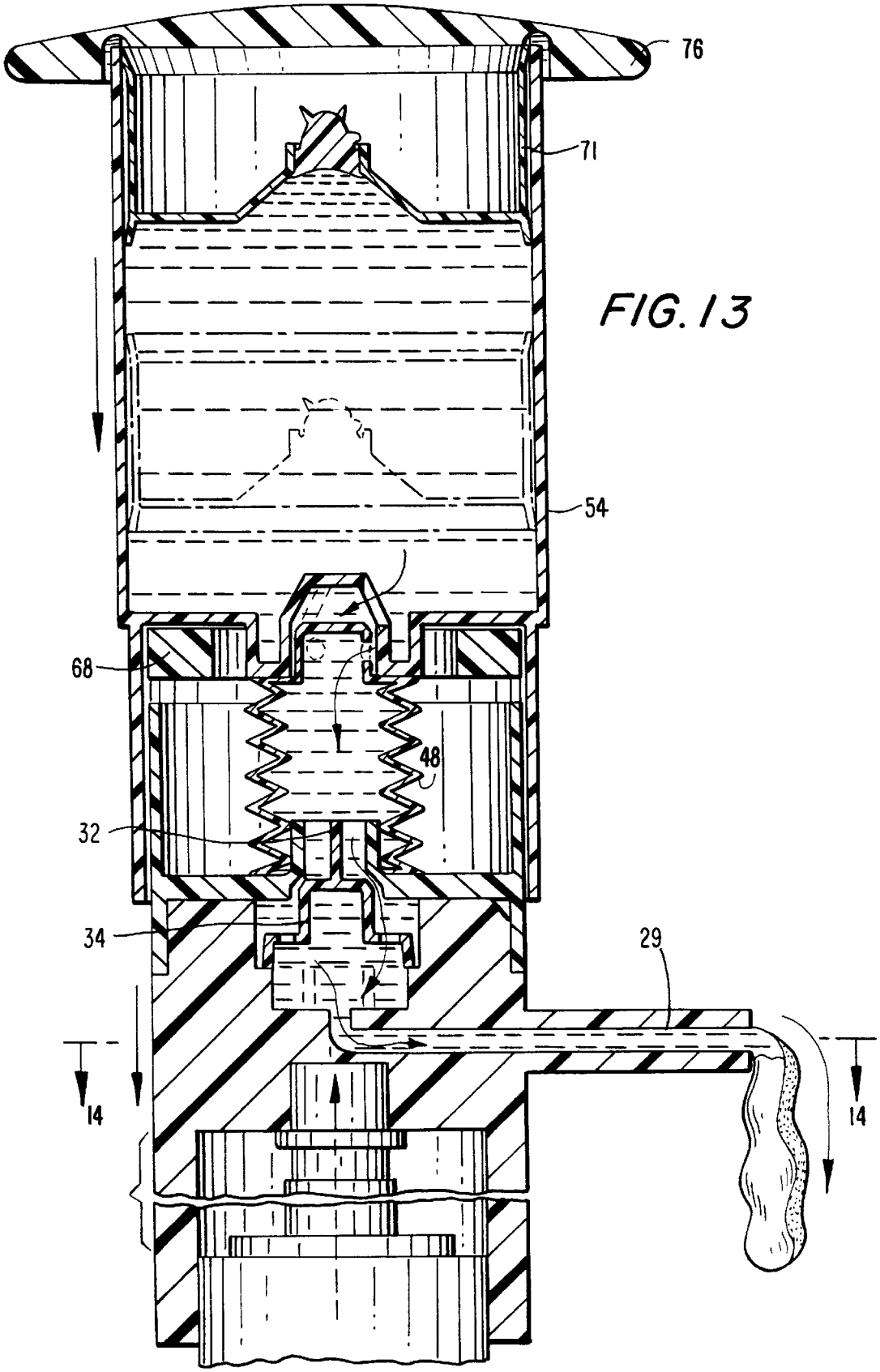
FIG. 13 is a cross section similar to FIG. 3 but showing the pump in operation.

The bottom of bellows 48 is disposed astride cylinder 42 as seen in FIG. 3.

Surrounding the upper outer cylinder of step shell 44 is lower aspect 50 of upper shell 52. In addition to lower aspect 50, which is cylindrical, upper shell 52 includes upper aspect 54, which is also cylindrical but which is of a greater diameter than lower aspect 50. Upper shell 52 also includes lower and upper circular openings 56, 58, respectively. Upper shell also comprises platform 60 which includes one way valve 62. Above platform 60 is upper aspect 54 and below platform 60 is lower aspect 50.

Adjustment collar 66 comprises torodial section 68 and a depending prong 70. In the assembled form of the upper pump, adjustment collar 66 is disposed just beneath the platform 60. Upper aspect 54 of upper shell 52 will serve as a reservoir for one of the components of the product to be pumped from the package. Above the component will be upper chamber piston 71 which forms a circular opening 72 at its top and a circular bottom wall 74. Upper chamber piston 71 is received within upper aspect 54 above the product reservoir and serves to confine the product in chamber formed by upper aspect 54 at its upper end. Piston 71 will be drawn by vacuum and follow the top of the product downwardly as product is depleted. Rims 102, 104 have an outside diameter slightly larger than the inside diameter of upper aspect 54. Rims 102, 104 may be made of, e.g. polyethylene or polypropylene. Cap 76 closes upper aspect 54 and mates with circular opening 58, as by inclusion of a cylindrical recess 78 into which opening 58 can be friction fit.

In operation, one component of the product to be dispensed will be disposed in bottle 12 and the other in upper aspect 54 of upper shell 52 below upper chamber piston 71. To dispense the product the consumer will exert pressure with his or her hand on cap 76. The force will be transmitted by upper shell 54 through platform 60 to adjustment collar 66 and bellows 48. The distance downwardly which the bellows can be compressed will depend upon the distance between the bottom of prong 70 and the step 46 below it. Adjustment collar 66 is adhered to and travels with upper shell 52. Upper shell 52 surrounds the upper half of step shell 44 and is rotatable with respect thereto. Rotation of the upper shell also rotates the adjustment collar which is affixed thereto. Thus, rotation of the upper shell rotates the adjustment collar and therefore the prong 70. Rotation of prong 70 changes its position with respect to the steps 46 of step shell 44, which remains stationary. Thus, turning upper shell 52 changes the step above which the prong 70 is disposed and to which the prong 70 travels when cap 76 is compressed.

For instance, if the prong 70 is disposed above the lowest step, it will have a longer distance to travel than where prong 70 is disposed above the highest step. Where prong 70 is disposed above the lowest step, the bellows will be compressible to a greater extent and will therefore pump more of the component disposed in the upper shell. Where the prong has less of a distance to travel, e.g. where the prong is disposed above the highest step, then less of the product in the upper shell will be dispensed with each stroke of the pump. Prong 70 is dimensioned so that it extends into the stepped area and below the lowest level of the upper edge of the step shell adjacent the steps. Thus, the prong is restricted in rotation to the areas above the steps. The steps serve as receptors for the prong of the adjustor.

Compression of the bellows forms a vacuum which draws product from upper aspect 54 through one way valve 62. Product exits bellows 48 and proceeds through cylinder 42 through lower valve 30. The pressure exerted by the product causes the flexible valve 30 to deflect at the base of cylinder 34 so that cylinder 34 and cruciform top 32 extend downwardly permitting product to exit through apertures 40. Cylinder 36 remains stationary affixed to lower shell 18. Cruciform top 32 retains valve 30 within cylinder 42 despite the downward deflection of the valve. Product forces lower valve downwardly and exits through apertures 40. Product is received in tube 29 and pumped out therethrough.

At approximately the same time, the same stroke by the consumer will result in pressure exerted on cylinder 16 of bottle 12. Pump 14 of bottle 12 will pump product upwardly into the downwardly turned proximal end of tube 26. Thus, both components of the product will be pumped more or less simultaneously as a result of a single pumping stroke of the consumer.

As explained above, the adjustment collar can be used to provide the consumer with the option to adjust the amount of the component in the upper shell which is dispensed. For instance, if a product containing a surfactant and moisturizer is dispensed using the package of the invention, the surfactant component may be present in the bottle 12 and the moisturizer may be present in upper aspect 54 of upper shell 52. The consumer may then adjust how much of the moisturizer he/she wants relative to the amount of surfactant by rotating the adjustment collar.

Figure 15:
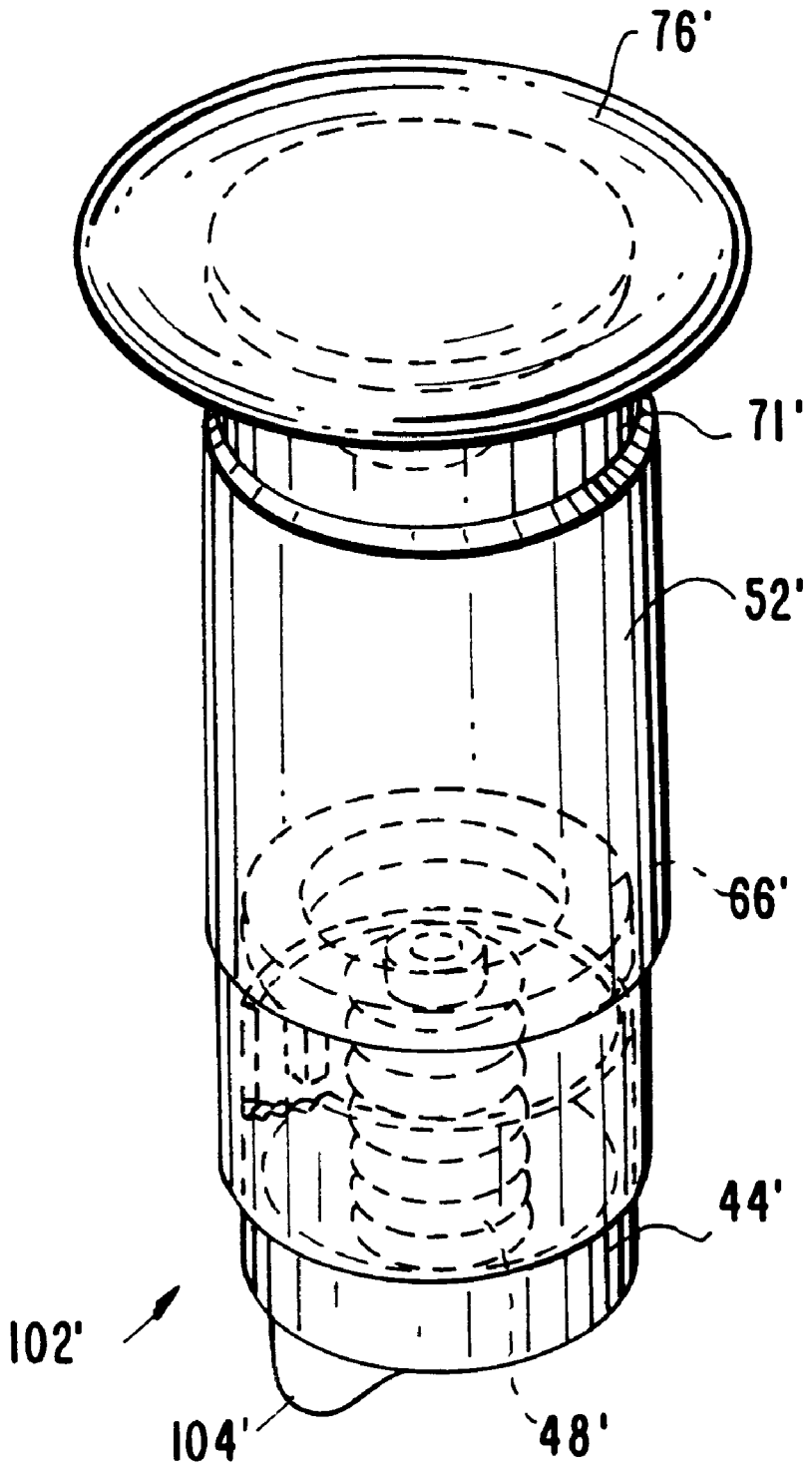
FIG. 15 is a perspective view of a refill according to the invention.

The parts of the package may be made of any suitable packaging material, especially plastics such as polyolefins, e.g. polypropylene. Flexible materials, such as deformable aspect 31 of valve 30 may be made of silicone rubber or other flexible plastic materials. If so desired, one or both of the chambers of the dispensers can be a unit which is readily removed and replaceable by a refill unit. For instance, FIG. 15 illustrates assembled refill section 102' comprising peelable membrane scale 104', cap 76', upper chamber piston 71', shell 52', adjustment collar 66', bellows 48' and step shell 44'.

The container of the invention is preferably free of electrical components. Thus, the container is quite different from prematically controlled dispensing devices such as that illustrated in Golden, U.S. Pat. No. 3,459,332 mentioned above.

While the invention has been illustrated as having a means for adjusting the amount of product dispensed from just one of the chambers, it will be apparent that more than one chamber can be provided with a metering device.

It should be understood of course that the specific forms of the invention herein illustrated and described or intended to be representative only, as certain may be made therein without departing from the clear teaching of the disclosure. Accordingly reference should be made to the appended claims in determining the full scope.

We claim:

1. A container including a first chamber and a second chamber, a pump for pumping the contents from within said first and second chambers to an outside of said container, said pump having an outer side, which is suitable for receiving a force which is to be transmitted to said pump during pumping the contents, an adjustor for manually adjusting a ratio of product dispensed by operation of said pump, said container including a pumping axis along which said pump moves during pumping, said adjustor being structured to change a distance along which said pump moves along said pumping axis during pumping.

2. The container according to claim 1 wherein said adjustor has a first position when said pump is not activated and being movable along said pumping axis by the force during pumping to a plurality of further positions, a plurality of adjustor receptors which do not move along said pumping axis during pumping, said adjustor receptors being disposed at different distances along said pumping axis from said adjustor first position, said adjustor including a projection projecting from said adjustor, at least one of said adjustor and receptors being rotatable with respect to each other transversely of said pumping axis whereby the distance traveled by the adjustor along the pumping axis during pumping can be adjusted by rotating the adjustor and the receptors relative to each other.

3. The container according to claim 2 wherein said receptors form a series of steps.

4. The container according to claim 3 wherein said receptor steps comprise a part of a shell.

5. The container according to claim 1, free of electrical components.

6. The container according to claim 1 further comprising means releasably connecting at least one of said chambers to the container whereby said chamber may be readily replaced with a refill chamber.

7. The container according to claim 6 wherein said releasably connected chamber comprises a first shell having a top and a bottom cylinder separated by a platform, said bottom cylinder having a smaller diameter than said top cylinder, said platform also including a one way valve, an adjustment collar received within said second cylinder below said platform, a bellows having two ends, a first bellows end being received within said valve and a second shell having side walls parallel to those of the second cylinder of said first shell.

8. A container including a first chamber and a second chamber, said first chamber comprising a surfactant-containing composition and said second chamber comprising a moisturizer containing composition, and an adjuster for manually adjusting the ratio of product dispensed from said container.

9. A container including a first chamber and a second chamber, said first chamber comprising a surfactant-containing composition and said second chamber comprising a moisturizer-containing composition, at least one of said chambers being separately removable and replaceable with a refill.

* * * * *